US006416917B1

(12) United States Patent
Nakanishi et al.

(10) Patent No.: US 6,416,917 B1
(45) Date of Patent: Jul. 9, 2002

(54) DRY TONERS HAVING SPECIFIED CONDENSATION BINDER RESINS

(75) Inventors: Hideo Nakanishi; Hajime Fukushima, both of Kyoto (JP)

(73) Assignee: Sanyo Chemical Industries Ltd., Kyoto (JP)

( * ) Notice: Subject to any disclaimer, the term of this patent is extended or adjusted under 35 U.S.C. 154(b) by 0 days.

(21) Appl. No.: 09/701,702

(22) PCT Filed: Mar. 28, 2000

(86) PCT No.: PCT/JP00/01905

§ 371 (c)(1),
(2), (4) Date: Dec. 1, 2000

(87) PCT Pub. No.: WO00/60418

PCT Pub. Date: Oct. 12, 2000

(30) Foreign Application Priority Data

Apr. 7, 1919 (JP) ..... 11-099540
Apr. 2, 1999 (JP) ..... 11-095648
Sep. 30, 1999 (JP) ..... 11-278619

(51) Int. Cl.[7] ..... G03G 9/087

(52) U.S. Cl. ..... 430/109.2; 430/109.4; 430/109.5; 430/110.3; 430/111.4

(58) Field of Search ..... 430/109.4, 109.2, 430/109.5, 111.4, 110.3

(56) References Cited

U.S. PATENT DOCUMENTS 2,297,691 A * 10/1942 Carlson ..... 430/31
4,908,290 A 3/1990 Yoichiro et al. ..... 430/106.6
5,691,095 A * 11/1997 Shinzo et al. ..... 430/106
5,773,183 A * 6/1998 Doujo et al. ..... 430/106
5,908,726 A * 6/1999 Inoue et al. ..... 430/109.4

FOREIGN PATENT DOCUMENTS

| | | | |
|---|---|---|---|
| EP | 1 026 554 | 8/2000 | ..... G03G/9/087 |
| JP | 62-205367 | 9/1987 | |
| JP | 10-10774 | 1/1998 | |
| JP | 10-268573 | 10/1998 | |
| JP | 10 288 859 | 1/1999 | ..... G03G/9/087 |

* cited by examiner

*Primary Examiner*—Christopher Rodee
(74) *Attorney, Agent, or Firm*—Morgan, Lewis & Bockius LLP

(57) ABSTRACT

Provided by the present invention are (1) a dry toner excellent in powder flowability and transferability when formed as a small-particle-size toner; (2) a dry toner excellent in any one of heat storage stability, low-temperature fixing property and anti-hot offset property; (3) a dry toner excellent in gloss exhibition when an image is formed by a full color copying machine; and (4) a dry toner which does not need application of an oil to a heat roll.

Described specifically, provided by the present invention is a dry toner comprising a toner binder and a colorant, wherein the toner has a Wadell's practical sphericity ranging from 0.90 to 1.00, the toner binder contains a high-molecular-weight condensation resin (A) and a low-molecular-weight condensation resin (B), a ratio (MnA/MnB) of the number average molecular weight (MnA) of the resin (A) to the number average molecular weight (MnB) of the resin (B) is at least 1.6, and a ratio (MwA/MwB) of the weight average molecular weight (MwA) of the resin (A) to the weight average molecular weight (MwB) of the resin (B) is at least 2.

14 Claims, No Drawings

DRY TONERS HAVING SPECIFIED CONDENSATION BINDER RESINS

TECHNICAL FIELD

The present invention relates to a dry toner suitable for use in electrophotography, electrostatic recording, electrostatic printing or the like.

BACKGROUND ART

As a dry toner for electrophotograpy, electrostatic recording, electrostatic printing or the like, those prepared by melting and kneading a toner binder such as styrene resin or polyester with a colorant and then pulverizing the resulting mass have been employed conventionally.

Such a dry toner is developed and transferred to a substrate such as paper and then fixed by hot melting using a heat roll. Upon hot melting, when the heat roll temperature is too high, there occurs a problem that the toner is excessively molten and sticks to the heat roll (hot offset). When the heat roll temperature is too low, there occurs a problem that the toner is not molten sufficiently and fixation is insufficient. From the viewpoints of energy saving and size reduction of apparatuses such as copying machine, there is a demand for the development of a toner having a higher hot offset occurring temperature (anti-hot offset property) and a low fixing temperature (low temperature fixing property).

In addition, a toner is required to have heat storage stability enough for preventing blocking of the toner particles during storage or at the atmospheric temperature in the apparatus.

Since the toner must have a melt viscosity as low as possible particularly in a full color copying machine or full color printer because of the necessity of good gloss and sufficient color mixing property for the formation of its image, a polyester toner binder having a sharp melt characteristic has mainly been employed. Such a toner tends to cause hot offset so that application of a silicone oil or the like onto a heat roll has been conducted in a full color copying or printing machine.

Application of a silicone oil onto a heat roll however needs an oil tank and oil coating apparatus, making the whole equipment complex and large-scale. In addition, it deteriorates the heat roll, which needs maintenance at certain intervals. Furthermore, it inevitably causes adhesion of an oil to a copying paper, OHP (overhead projector) film or the like and particularly in OHP, the color tone of an OHP film is deteriorated by the adhered oil.

In recent years, there is a strong demand for a reduction in the particle size of a toner for higher image quality and improvement in resolution. The conventional toner obtained by kneading and pulverization has not a uniform shape so that a reduction in its particle size deteriorates powder flowability, causing problems such as difficulty in feeding of the resulting toner to a developing apparatus and worsening of transferability.

As a toner having heat storage stability, low-temperature fixing property and anti-hot offset property, thereby overcoming some of the above-described problems, proposed are (1) that [JP-A-57-109825 (the term "JP-A" as used herein means an "unexamined published Japanese patent application)] using, as a toner binder, a polyester which has been partially crosslinked using a polyfunctional monomer and (2) that [JP-B-7-101318 (the term "JP-B" as used herein means an "examined published Japanese patent publication")] using, as a toner, binder, an urethane-modified polyester.

As a toner for full color printing or copying which is reduced in an oil application amount to a heat roll, proposed is (3) that (JP-A-7-56390) obtained by granulating polyester fine particles and wax fine particles.

As a toner having a reduced particle size, but being improved in powder flowability and transferability, proposed are (4) a toner (JP-A-9-43909) obtained by dispersing a vinyl monomer composition containing a colorant, a polar resin and a releasing agent in water and then subjecting the resulting dispersion to suspension polymerization and (5) a toner (JP-9-34167) comprising spherical particles which is obtained by treating the toner made of a polyester resin with a solvent in an aqueous medium.

Owing to insufficient powder flowability and transferability, however, the toner disclosed in any one of (1) to (3) cannot attain high image quality when reduced in its particle size.

The toner disclosed in (1) or (2) does not attain heat storage stability and low temperature fixing property simultaneously, and in addition, is not suited for use in a full color printing or copying machine because it does not exhibit gloss.

The toner disclosed in (3) is not satisfactory in hot offset property upon oil-less fixation as well as in low temperature fixing property.

The toner disclosed in (4) is improved in powder flowability and transferability, but owing to insufficient low-temperature fixing property, it needs much energy for fixation. Particularly in a toner for full color image, this problem is marked.

The toner disclosed in (5) is improved in powder flowability and transferability. It is superior to that of (4) in low temperature fixing property, but owing to insufficient anti-hot offset property, oil application to a heat roll cannot be omitted when used for the formation of a full color image.

An object of the present invention is to provide a dry toner having excellent powder flowability and transferability when reduced in its particle size.

Another object of the present invention is to provide a dry toner excellent in any one of heat storage stability, low temperature fixing property and anti-hot offset property.

A further object of the present invention is to provide a dry toner having excellent gloss exhibition when an image is formed by a full color copying machine or the like.

A still further object of the present invention is to provide a dry toner which does not need oil application to a heat roll.

DISCLOSURE OF THE INVENTION

Extensive investigation with a view to attaining the above-described objects has lead to the present invention.

Described specifically, the present invention provides a dry toner comprising a toner binder and a colorant, characterized in that the toner has a Wadell's practical sphericity of 0.90 to 1.00, the toner binder contains a high molecular weight condensation resin (A) and a low molecular weight condensation resin (B), a ratio (MnA/MnB) of the number average molecular weight (MnA) of the resin (A) to the number average molecular weight (MnB) of the resin (B) is at least 1.6 and a ratio (MwA/MwB) of the weight average molecular weight of the resin (A) to the weight average molecular weight of the resin (B) is at least 2.

BEST MODE FOR CARRYING OUT THE INVENTION

The present invention will hereinafter be described more specifically.

The term "Wadell's practical sphericity" as used herein means a quotient resulting from (the diameter of a circle equivalent to the projected area of a particle)÷(the diameter of the minimum circumcircle with the projected image of the particle) and it can be measured by electron microscopic observation of toner particles.

The Wadell's practical sphericity is usually 0.90 to 1.00, preferably 0.95 to 1.00, more preferably 0.98 to 1.00. In the present invention, the practical sphericity of all the toner particles does not necessarily fall within the above-described range, but average may fall within the above-described range. The average is obtained from the practical sphericity of about 20 particles taken out at random from the toner particles produced.

As the particle size of the toner, the median diameter ($d_{50}$) is usually 2 to 20 $\mu$m, preferably 3 to 10 $\mu$m.

Examples of the high-molecular-weight condensation resin (A) and low-molecular-weight condensation resin (B), each constituting the toner binder, include polyester, polyurethane, polyurea, polyamide and epoxy resins, of which the polyester, polyurethane and epoxy resins are preferred, with the polyester resin being particularly preferred.

As the polyester resin, polycondensates between a polyol (1) and a polycarboxylic acid (2) can be given as examples.

Examples of the polyol (1) include diols (1-1) and polyols (1-2) having at least 3 functional groups. Among them, single use of (1-1) or a mixture of (1-1) with a small amount of (1-2) is preferred. The mixture contains (1-1) and (1-2) usually at a molar ratio of 100/0 to 100/20, preferably 100/0 to 100/10.

Examples of the diol (1-1) include: $C_{2-18}$ alkylene glycols (such as ethylene glycol, 1,2-propylene glycol, 1,3-propylene glycol, 1,4-butanediol, neopentyl glycol, 1,6-hexanediol and dodecane diol), $C_{4-1000}$ alkylene ether glycols (such as diethylene glycol, triethylene glycol, dipropylene glycol, polyethylene glycol, polypropylene glycol and polytetramethylene ether glycol), alicylic $C_{5-18}$ diols (such as 1,4-cyclohexane dimethanol and hydrogenated bisphenol A);

$C_{12-23}$ bisphenols (such as bisphenol A, bisphenol F and bisphenol S); and $C_{2-18}$ alkylene oxide (such as ethylene oxide, propylene oxide, butylene oxide and $\alpha$-olefin oxide) adducts (the number of moles added: 2 to 20) of each of the above-exemplified alicyclic diols and bisphenols.

Among them, preferred are $C_{2-12}$ alkylene glycols and $C_{2-18}$ alkylene oxide adducts of each of bisphenols, with combined use of an alkylene oxide adduct (particularly, a 2 to 3 mole ethylene oxide or propylene oxide adduct) of a bisphenol (particularly, bisphenol A) with a $C_{2-12}$ alkylene glycol (particularly, ethylene glycol, 1,2-propylene glycol, 1,4-butanediol or neopentyl glycol) being particularly preferred.

When used in combination, an alkylene oxide adduct of a bisphenol is usually added in an amount of 30 mole % or greater, with 50 mole % or greater being more preferred and 70 mole % or greater being particularly preferred.

Examples of the polyol (1-2) having at least 3 functional groups include:

aliphatic polyhydric alcohols having 3 to 8 or greater functional groups (such as glycerin, trimethylolethane, trimethylolpropane, pentaerythritol and sorbitol);

phenols having 3 to 8 or greater functional groups (such as trisphenol PA, phenol novolac and cresol novolac); and $C_{2-18}$ alkylene oxide adducts (the number of moles added: 2 to 20) of each of the above-exemplified polyphenols having at least 3 functional groups.

Examples of the polycarboxylic acid (2) include dicarboxylic acids (2-1) and polycarboxylic acids (2-2) having at least 3 functional groups. A single use of (2-1) or a mixture of (2-1) with a small amount of (2-2) is preferred. When used as a mixture, (2-1) and (2-2) are mixed usually at a molar ratio of 100/0 to 100/20, preferably 100/0 to 100/10.

Examples of the dicarboxylic acid (2-1) include:

$C_{2-20}$ alkylenedicarboxylic acids (such as succinic acid, adipic acid, sebacic acid, dodecanedicarboxylic acid, dodecenylsuccinic acid and dodecylsuccinic acid); alkenylenedicarboxylic acids (such as maleic acid and fumaric acid); and aromatic dicarboxylic acids (phthalic acid, isophthalic acid, terephthalic acid and naphthalenedicarboxylic acid).

Among them, preferred are $C_{4-20}$ alkylenedicarboxylic acids (particularly, adipic acid and dodecenylsuccinic acid), $C_{4-20}$ alkenylenedicarboxylic acids (particularly, maleic acid and fumaric acid) and $C_{8-20}$ aromatic dicarboxylic acids (particularly, isophthalic acid and terephthalic acid).

Examples of the polycarboxylic acid (2-2) having at least 3 functional groups include aromatic $C_{9-20}$ polycarboxylic acids (such as trimellitic acid and pyromellitic acid).

The acid anhydride or lower alkyl ester (such as methyl ester, ethyl ester or isopropyl ester) of the above-exemplified dicarboxylic acid or polycarboxylic acid may be reacted, as the polycarboxylic acid (2), with the polyol (1).

A ratio of the polyol (1) to the polycarboxylic acid (2) is usually 2/1 to 1/2, preferably 1.5/1 to 1/1.5, more preferably 1.3/1 to 1/1.3 in terms of [OH]/[COOH], a molar ratio of a hydroxyl group [OH] to a carboxyl group [COOH].

The polyester resin used in the invention is available by heating the polycarboxylic acid and polyol to 150 to 280° C. in the presence of a known esterifying catalyst such as tetrabutoxy titanate or dibutyltin oxide, thereby dehydrating and condensing them. Pressure reduction is effective for improving the reaction velocity at the end of the reaction.

As the high-molecular-weight polyester (A) in the present invention, polyesters each modified with a urethane bond and/or urea bond are preferred.

Among the polyesters modified with a urethane bond and/or urea bond, examples of the polyester modified with a urethane bond include reaction products of a polyester—which is a polycondensate of a polyol (1) and a polycarboxylic acid (2) and has a hydroxyl group—and a polyisocyanate (3).

Incorporation of the hydroxyl group in the polycondensate of the polyol (1) and polycarboxylic acid (2) is conducted, for example, by reacting them while setting the mole number of the hydroxyl group in (1) to exceed that of the carboxyl group in (2).

Examples of the polyol (1) include the above-exemplified diols (1-1) and polyols (1-2) having at least 3 functional groups, while examples of the polycarboxylic acid (2) include the above-exemplified dicarboxylic acids (2-1) and polycarboxylic acids having at least 3 functional groups.

The polyol (1) and the polycarboxylic acid (2) are added usually at a ratio of 2/1 to 1/1, preferably 1.5/1 to 1/1, more preferably 1.3/1 to 1.02/1, each in terms of [OH]/[COOH], an equivalent ratio of a hydroxyl group [OH] to a carboxyl group [OH].

The number average molecular weight of the hydroxyl-containing polyester is usually 1000 to 20000, with 1500 to 15000 being preferred and 2000 to 10000 being particularly preferred, while its weight average molecular weight is usually 2000 to 50000, with 3000 to 30000 being preferred and 4000 to 20000 being particularly preferred.

The hydroxyl number of the hydroxyl-containing polyester is usually 5 to 120, with 7 to 70 being preferred and 10 to 60 being particularly preferred, while its acid number is usually 10 or less, with 5 or less being preferred and 2 or less being particularly preferred.

Examples of the polyisocyanate (3) include aromatic polyisocyanates having 6 to 20 carbon atoms (except carbon atoms in the NCO group, this will apply equally hereinafter), aliphatic polyisocyanates having 2 to 18 carbon atoms, alicyclic polyisocyanates having 4 to 15 carbon atoms, and araliphatic polyisocyanates having 8 to 15 carbon atoms; modified products thereof (urethane, carbodiimido-, allophanate-, urea-, biuret-, urethodion-, urethoimine-, isocyanurate or oxazolidone-containing modified products); and mixtures of two or more of these compounds.

Specific examples of the aromatic polyisocyanate include 1,3- and/or 1,4-phenylene diisocyanate, 2,4-and/or 2,6-tolylene diisocyanate (TDI), crudely produced TDI, 2,4'- and/or 4,4'-diphenylmethane diisocyanate (MDI), crudely produced MDI {a phosgenite of a crudely produced diaminophenylmethane [a condensate of formaldehyde and an aromatic amine (aniline) or mixture thereof; a mixture of diaminodiphenylmethane and a small amount (ex. 5 to 20 wt. %) of a polyamine having at least 3 functional groups]: polyallyl polyisocyanate (PAPI)}, 1,5-naphthylene diisocyanate, 4,4',4"-triphenylmethane triisocyanate and m- and p-isocyanatophenylsulfonyl isocyanate.

Specific examples of the aliphatic polyisocyanate include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-diisocyanato hexanoate.

Specific examples of the alicyclic polyisocyanate include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate and 2,5- and/or 2,6-norbornane diisocyanate.

Specific examples of the aromatic alicyclic polyisocyanate include m- and/or p-xylylene diisocyanate (XDI) and $\alpha,\alpha,\alpha',\alpha'$-tetramethyl xylylene diisocyanate (TMXDI).

The above-described modified polyisocyanates embrace modified (MDI) (such as urethane-modified MDI, carbodiimido-modified MDI or trihydrocarbylphosphate-modified MDI) and urethane-modified TDI, and mixtures of two or more of these compounds [for example, combined use of modified MDI with urethane-modified TDI (isocyanate-containing prepolymer)].

Among them, preferred are aromatic polyisocyanates having 6 to 15 carbon atoms, aliphatic polyisocyanates having 4 to 12 carbon atom, and alicyclic polyisocyanates having 4 to 15 carbon atoms, with TDI, MDI, HDI, hydrogenated MDI and IPDI being particularly preferred.

Upon reaction of the hydroxyl-containing polyester with the polyisocyanate (3), another polyol can be used in combination.

The polyisocyanate (3) is added usually at a ratio of 1/2 to 2/1, preferably 1.5/1 to 1/1.5, more preferably 1.2/1 to 1/1.2 in terms of [NCO]/[OH], the equivalent ratio of the isocyanate group [NCO] to the total of [OH] of the hydroxyl-containing polyester and another polyol.

The polyester modified with a urethane bond can be prepared, for example, by the following process Described specifically, a polyester modified with a urethane bond is prepared by heating a polyol (1) and a polycarboxylic acid (2) to 150 to 280° C. in the presence of a known esterifying catalyst such as tetrabutoxy titanate or dibutyltin oxide, distilling off the resulting water while reducing the pressure if necessary to obtain a hydroxyl-containing polyester, and reacting the hydroxyl-containing polyester with a polyisocyanate (3) and, if necessary, a polyol at 50 to 140° C. Upon reaction with (3), a solvent can be employed if necessary. Examples of the usable solvent include aromatic solvents (such as toluene and xylene), ketones (such as acetone, methyl ethyl ketone and methyl isobutyl ketone), esters (such as ethyl acetate), amides (such as dimethylformamide and dimethylacetamide), and ethers (such as tetrahydrofuran) which are inert to the isocyanate (3).

Examples of the polyester modified with a urea bond include reaction products of an isocyanate-containing polyester prepolymer (a) and an amine (b).

Examples of the isocyanate-containing prepolymer (a) include products obtained by reacting a polyester—which is a polycondensate of a polyol (1) and a polycarboxylic acid (2) and has an active-hydrogen-containing group—with a polyisocyanate (3).

As the active-hydrogen-containing group of the above-described polyester, a hydroxyl group (such as alcoholic hydroxyl group or phenolic hydroxyl group) and a carboxyl group can be given as examples. Among them, an alcoholic hydroxyl group is preferred.

The alcoholic-hydroxyl-containing polyester is available by using the polyol excessively as in the case of the polyester modified with a urethane bond. The carboxyl-containing polyester is, on the other hand, available by the excessive use of the polycarboxylic acid.

As the polyol (1), polycarboxylic acid (2) and polyisocyanate (3), those exemplified in the above description of the polyester modified with a urethane bond can be given. Preferred ones are also similar.

The polyisocyanate (3) is added usually at a ratio of 5/1 to 1/1, preferably 4/1 to 1.2/1, more preferably 2.5/1 to 1.5/1 in terms of [NCO]/[OH], the equivalent ratio of the isocyanate group [NCO] to the hydroxyl group [OH] of the hydroxyl-containing polyester.

The NCO content (NCO equivalent) is usually 500 to 10000, preferably 700 to 8000, particularly 1000 to 5000.

Examples of the amine (b) include diamines (b1), polyamines (b-2) having 3 to 6 or greater functional groups, amino alcohols (b3), aminomercaptanes (b4), amino acids (b5) and amines (b6) obtained by blocking the amino group of (b1) to (b5).

Examples of the diamine (b1) include aromatic $C_{6-23}$ diamines (such as phenylenediamine, diethyltoluenediamine and 4,4'-diaminodiphenylmethane), alicyclic $C_{5-20}$ diamines (such as 4,4'-diamino-3,3'-dimethyldicyclohexylmethane, diaminocyclohexane and isophoronediamine), and aliphatic $C_{2-18}$ diamines (such as ethylenediamine, tetramethylenediamine and hexamethylenediamine).

Examples of the polyamine (b2) having 3 to 6 or greater functional groups include diethylenetriamine and triethylenetetramine.

Examples of the amino alcohol (b3) include $C_{2-12}$ ones, more specifically, ethanolamine and hydroxyethylaniline.

Examples of the aminomercaptane (b4) include $C_{2-12}$ ones, more specifically, aminoethylmercaptane and aminopropylmercaptane.

Examples of the amino acid (b5) include $C_{2-12}$ ones, more specifically, aminopropionic acid and aminocaproic acid.

Examples of the amines obtained by blocking the amino group of the amines (b1) to (b5) include ketimine compounds and oxazoline compounds available from the above-exemplified amines (b1) to (b5) and $C_{3-8}$ ketones (such as acetone, methyl ethyl ketone and methyl isobutyl ketone).

Among the above-exemplified amines (b), preferred are (b1) (particularly, 4,4'-diaminodiphenylmethane, isophoronediamine and ethylenediamine) and mixtures of (b1) and a small amount of (b2) (particularly, diethylenetriamine), of which those having a blocked amino group are more preferred.

The (b1) and (b2) are mixed usually at a molar ratio of 100/0 to 100/10, preferably 100/0 to 100/5.

If necessary, a reaction terminator is added to adjust the molecular weight of the urea-modified polyester. Examples of the reaction terminator include monoamines (such as diethylamine, dibutylamine, butylamine and laurylamine) and the blocked products thereof (such as ketimine compounds).

The amine (b) is added usually at a ratio of 1/2 to 2/1, preferably 1.5/1 to 1/1.5, more preferably 1.2/1 to 1/1.2 in terms of [NCO]/[NHx], the equivalent ratio of the isocyanate group [NCO] in the isocyanate-containing prepolymer (a) to an amino group [NHx] in the amine (b).

In the present invention, the polyester modified with a urea bond may additionally contain a urethane bond.

The ratio of the urea bond to the urethane bond is usually 10/0 to 1/9, preferably 8/2 to 2/8, more preferably 6/4 to 3/7.

The polyester modified with a urea bond can be prepared, for example, by the below-described process.

Described specifically, the polyester modified with a urea bond is prepared by obtaining a hydroxyl-containing polyester in a similar to above, reacting the resulting polyester with the polyisocyanate (3) at 40 to 140° C. to obtain the corresponding isocyanate-containing prepolymer, and reacting the resulting prepolymer with the amine (or blocked product thereof) at 0 to 140° C. Upon reaction, a solvent can be used if necessary. As the solvent, those exemplified above can be employed.

As the polyurethane in the present invention, a polyadduct of a polyol (1) and a polyisocyanate (3) can be given as an example.

Examples of the polyol (1) include the above-exemplified diols (1-1) and polyols (1-2) having at least 3 functional groups.

Examples of the polyisocyanate (3) include the above-exemplified aromatic polyisocyanates having 6 to 20 carbon atoms (except carbon atoms in the NCO group, this will apply equally hereinafter), aliphatic polyisocyanates having 2 to 18 carbon atoms, alicyclic polyisocyanates having 4 to 15 carbon atoms, and araliphatic polyisocyanates having 4 to 15 carbon atoms; modified products thereof (urethane, carbodiimido-, allophanate-, urea-, biuret-, urethodion-, urethoimine-, isocyanurate- or oxazolidone-containing modified products); and mixtures of two or more of these compounds.

Examples of the polyurea usable in the present invention include reaction products of the above-exemplified polyisocyanate (3) and an amine (b).

Examples of the amine (b) include the above-exemplified diamines (b1), polyamines (b-2) having 3 to 6 or greater functional groups, amino alcohols (b3), aminomercaptanes (b4), amino acids (b5) and amines (b6) obtained by blocking the amino group of (b1) to (b5).

Among these amines (b), preferred are (b1) (particularly, 4,4'-diaminodiphenylmethane, isophoronediamine or ethylenediamine) and a mixture of (b1) with a small amount of (b2) (particularly, diethylenetriamine). In the mixture, the (b1) and (b2) are added usually at a molar ratio of 100/0 to 100/10, preferably 100/0 to 100/5.

If necessary, a reaction terminator is added to adjust the molecular weight of the polyurea. Examples of the reaction terminator include monoamines (such as diethylamine, dibutylamine, butylamine and laurylamine) and the blocked products thereof (such as ketimine compounds).

The amine (b) is added usually at a ratio of 1/2 to 2/1, preferably 1-5/1 to 1/1.5, more preferably 1.2/1 to 1/1.2 in terms of [NCO]/[NHx], the molar ratio of the isocyanate group [NCO] in the polyisocyanate (3) to an amino group [NHx] in the amine (b).

When any one of (b3) to (b5) is employed as the amine (b), [NCO]/[YHx], the molar ratio of the amino group [NCO] to [YHx], the total of the hydroxyl, mercapto or carboxyl group in (b) is usually 1/2 to 2/1, preferably 1.5/1 to 1/1.5, more preferably 1.2/1 to 1/1.2.

Adjustment of the molar ratio within the above-described range increases the molecular weight of the polyurea, thereby improving the anti-hot offset property.

Examples of the polyamide include polycondensates of a polycarboxylic acid (2) and an amine (b).

Examples of the polycarboxylic acid (2) include the above-exemplified dicarboxylic acids (2-1) and polycarboxylic acids (2-2) having at least 3 functional groups.

Examples of the amine (b) include the above-exemplified diamines (b1), polyamines (b-2) having 3 to 6 or greater functional groups, amino alcohols (b3), aminomercaptanes (b4), amino acids (b5) and amines (b6) obtained by blocking the amino group of (b1) to (b5).

Examples of the epoxy resin include addition condensates of a bisphenol (such as bisphenol A, bisphenol F or bisphenol S) and epichlorohydrin.

In the present invention, a ratio (MnA/MnB) of the number average molecular weight of the high-molecular-weight resin (A) to that of the low-molecular-weight resin (B) must be at least 1.6, preferably at least 1.9, more preferably 2.1 to 33, with 2.3 to 28 being particularly preferred. At a ratio less than 1.6, anti-hot offset property becomes insufficient when low-temperature fixing property is improved, while low-temperature fixing property becomes insufficient when anti-hot offset property is improved.

The resin (A) usually has a number average molecular weight (MnA) of at least 5000, preferably 6000 to 100000, more preferably 6500 to 60000.

The resin (B) has usually a number average molecular weight (MnB) of 1000 to 5000, preferably 1300 to 4000, more preferably 1500 to 3500.

A ratio (MwA/MwB) of the weight average molecular weight of the resin (A) to that of the resin (B) must be at least 2.0, preferably 2.5 to 100, more preferably 4.0 to 70, with 5.0 to 50 being particularly preferred. At a ratio less than 2.0, anti-hot offset property becomes insufficient when low-temperature fixing property is improved, while low-temperature fixing property becomes insufficient when anti-hot offset property is improved.

The resin (A) has usually a weight average molecular weight (MwA) of at least 5000, preferably 6000 to 1000000, more preferably 8000 to 500000.

The resin (B) has usually at a weight average molecular weight (MwB) of 1000 to 50000, preferably 1500 to 20000, more preferably 2000 to 20000.

The weight ratio of the resin (A) to the resin (B) is usually 5/95 to 60/40, preferably 8/92 to 55/45, more preferably 10/90 to 50/50, with 15/85 to 40/60 being particularly preferred.

In the dry toner of the present invention, the toner binder contained therein is desired to have at least 2 peaks in the molecular weight distribution as measured by gel permeation chromatography (GPC).

Moreover, in the molecular weight distribution as measured by GPC, the toner binder is desired to have at least one peak in each of the region having a peak molecular weight less than 20000 and the region having a peak molecular weight of 30000 or greater.

The "molecular weight distribution" as used herein is measured by gel permeation chromatography (which will hereinafter be abbreviated as "GPC") using tetrahydrofuran (which will hereinafter be abbreviated as "THF") as a solvent and determined with a reference to a calibration curve drawn based on standard polystyrene.

The specific conditions for measurement of the molecular weight are as follows:

Apparatus: "HLC-802A", product of Tosoh Corporation)

Column: TSK gel GMH6, two columns (product of Tosoh Corporation)

Measurement temperature: 25° C.

Sample solution: a 0.5 wt. % THF solution

Amount of the solution poured: 200 $\mu$l

Detector: Reflective index detector

The molecular weight calibration curve was drawn using standard polystyrene (molecular weight: 8420000, 4480000, 2890000, 1090000, 355000, 190000, 96400, 37900, 19600, 9100, 2980, 870, 500).

In the dry toner of the present invention, the difference (SPA-SPB) between the SP value (SPA) of the high-molecular-weight condensation resin (A) and the SP value (SPB) of the low-molecular-weight condensation resin (B), each constituting the toner binder, is usually at least 0.1, preferably at least 0.2, more preferably at least 0.3 from the viewpoint of anti-hot offset property. The SP value can be calculated by the known Fedors method.

In the present invention, the toner binder usually has a glass transition point (Tg) of 35 to 85° C., preferably 45 to 70° C., from the viewpoints of the heat storage stability and low-temperature fixing property.

The temperature (TG') at which the toner binder exhibits a storage elastic modulus of 10000 dyne/cm$^2$ at a measurement frequency of 20 Hz is usually 100° C. or greater, preferably 110 to 200° C., from the viewpoint of the anti-hot offset property.

The temperature (Tη) at which the toner binder exhibits the viscosity of 1000 poises at a measurement frequency of 20 Hz is usually 180° C. or less, preferably 90 to 160° C., from the viewpoint of the low-temperature fixing property.

For simultaneous accomplishment of low-temperature fixing property and anti-hot offset property, TG' is preferably higher than Tη. In other words, the difference between TG' and Tη (TG'−Tη) is preferably 0° C. or more, more preferably 10° C. or more, particularly preferably 20° C. or more.

For simultaneous accomplishment of heat storage stability and low-temperature fixing property, the difference between Tη and Tg is preferably 100° C. of less, of which 90° C. or less is more preferred and 80° C. or less is particularly preferred.

The dynamic viscoelasticity is measured under the following conditions.

Apparatus: "RDS-7700II Dynamics Spectrometer", product of Rheometrics Inc., U.S.A.

Test fixture: use of 25 mmχ cornplate

Measurement temperature: 100 to 240° C.

Measurement frequency: 20 Hz (125.6 rad/sec)

Strain: 5% (fixed)

As the colorant, known dyes, pigments and magnetic powders can be used in the present invention.

Specific examples of the dye include Sudan black SM, Fast yellow G, Rhodamine FB, Rhodamine B lake, Methyl violet B lake, Brilliant green, Oil yellow GG, Kayaset YG, Orazole brown B and oil pink OP; those of the pigment include Carbon black, Benzidine yellow, Pigment yellow, Indofast orange, Irgasine red, Baranito aniline red, Toluidine red, Carmine FB, Pigment orange R, Lake red 2G, Phthalocyanine blue, Pigment blue and Phthalocyanine green; and those of the magnetic powder include magnetite and iron black. Among them, preferred are colorants selected from the group consisting of dyes such as cyan, magenta and yellow and the group consisting of pigments such as cyan, magenta and yellow.

The content of the colorant is usually 2 to 15 wt. %, preferably 3 to 10 wt. %.

Together with the toner binder and colorant, a wax can also be added.

As the wax, known ones can be employed in the present invention. Examples include polyolefin waxes (such as polyethylene wax and polypropylene wax), long-chain hydrocarbons (such as paraffin wax and Sazole wax), and carbonyl-containing waxes, of which the carbonyl-containing waxes are preferred.

Examples of the carbonyl-containing wax include polyalkanoate esters (such as carnauba wax, montan wax, trimethylolpropane tribehenate, pentaerythritol tetrabehenate, pentaerythritol diacetate dibehenate, glycerin tribehenate and 1,18-octadecanediol-bis-stearate), polyalkanol esters (such as tristearyl trimellitate, distearyl maleate), polyalkanoic amides (such as ethylenediaminedibehenylamide), polyalkylamides (such as tristearylamide trimellitate), and dialkylketones (such as distearylketone).

Among these carbonyl-containing waxes, polyalkanoate esters are preferred.

The wax in the present invention usually has a melting point of 40 to 160° C., preferably 50 to 120° C., more preferably 60 to 90° C., from the viewpoint of heat storage stability and cold offset upon fixation.

The wax has, as measured at a temperature higher by 20° C. than the melting point, preferably a melting point of 5 to 1000 cps, more preferably 10 to 100 cps, from the viewpoints of anti-hot offset property and low-temperature fixing property.

The content of the wax in the toner is usually 0 to 40 wt. %, of which 3 to 30 wt. % is preferred and 10 to 25 wt. % is particularly preferred.

To the dry toner of the present invention, a charge control agent and fluidizing agent can be added further.

Examples of the charge control agent include known ones such as nigrosine dyes, quaternary ammonium salt compounds, quaternary-ammonium-base-containing polymers, metal-containing azo dyes, metal salts of salicylic acid, sulfonic-acid-containing polymers, fluorine-containing polymers and halogen-substituted-aromatic-ring-containing polymers.

The charge control agent is usually added in an amount of 0 to 5 wt. %.

Examples of the fluidizing agent include known ones such as colloidal silica, alumina powder, titanium oxide powder and calcium carbonate powder.

The dry toner can be prepared by any one of the following processes (1) to (3):

(1) Sphering of a Pulverized Toner

A method of kneading a toner material comprising a toner binder and a colorant under a molten state, pulverizing the resulting mass and then, mechanically forming the fine particles into a spherical form by a hybridizer or mecanofusion.

(2) Spray Drying

A method of obtaining a spherical toner by dissolving and dispersing a toner material in a solvent wherein the toner binder is soluble, and removing the solvent by a spray drying apparatus.

(3) Dispersion granulation (for example, the method as described in JP-A-9-15902)

A method of obtaining a spherical toner by dissolving and dispersing a toner material in a solvent wherein the toner binder is soluble, dispersing it in a poor solvent (such as water or water-methanol) of the toner binder under stirring, distilling off the solvent to form toner particles, and then cooling, subjecting to solid-liquid separation and drying the residue.

Among the above-exemplified three methods, the dispersion granulation (3) is preferred, of which the dispersion granulation using an aqueous medium as the poor solvent serving as a disperse phase is particularly preferred.

As a convenient method for obtaining a high-molecular-weight polyester, it is preferred to dissolve and disperse an isocyanate-containing polyester and a blocked amine (extender) together with other components (such as low-molecular-weight polyester, pigment and additive) in an organic solvent, followed by dispersion and granulation in water while forming a high-molecular weight polyester by the extending reaction during from the dispersing step to the solvent removal step.

Examples of the solvent which is employed in the dispersion granulation in an aqueous medium and in which the toner binder is dissolved in advance include ethyl acetate, acetone and methyl ethyl ketone.

If necessary, a dispersing agent can be employed. Use of a dispersing agent is preferred, because it sharpens the particle size distribution and provides stable dispersion.

Examples of the dispersing agent include organic dispersing agents such as water-soluble high molecules (α) and surfactants (β), and inorganic dispersing agents (γ). Examples of (α) include nonionic water-soluble high molecules (α-1), anionic water-soluble high molecules (α-2) and cationic water-soluble high molecules (α-3).

Specific examples of (α-1) include polyvinyl alcohol, hydroxyethyl cellulose, polyacrylamide and modified polyether; those of (α-2) include polystyrene sulfonate salts, polyacrylate salts and carboxymethyl cellulose sodium salts; and those of (α-3) include polystyrene quaternary ammonium salts, polyvinylimidazoline hydrochlorides and polyallylamine hydrochlorides.

Specific examples of (β) include sodium lauryl sulfate and sodium oleate.

Specific examples of (γ) include calcium carbonate powder, calcium phosphate powder and silica fine powder.

Dispersing agents may be used either singly or in combination.

The dispersing agent is added usually in an amount of 0.1 to 20 wt. %, preferably 0.5 to 10 wt. %.

When the dispersing agent is used, it is possible to leave it on the surface of the toner particles, but removal of it by washing after solvent removal is preferred in consideration of the charge of the toner.

The dispersing agent to be employed is preferably an organic dispersing agent such as water-soluble high molecule (α) or surfactant (β) when easiness of the removal by washing is taken into consideration.

The dry toner of the present invention is used as an electric latent image developer after mixed, if necessary, with carrier particles such as an iron powder, glass beads, nickel powder, ferrite, magnetite, ferrite having a surface coated with a resin (such as acrylic resin or silicone resin). An electric latent image can also be formed by the friction with a member such as a charging blade instead of using carrier particles.

The dry toner of the present invention is used as a recording material by being fixed to a substrate (such as paper or polyester film) through a known fixing system.

Examples of the fixing system include heat fixing systems such as infrared lamp system, xenon flash system, planar heater system, heat roller fixing system, heat belt fixing system and high frequency fixing system; pressure fixing system; and solvent fixing system, of which the heat fixing system is preferred, with xenon flash system, planar heater system, heat roller fixing system and heat belt fixing system being more preferred and heat roller fixing system and heat belt fixing system being particularly preferred.

EXAMPLES

The present invention will hereinafter be described by Examples in further detail. It should however be borne in mind that the present invention is not limited to or by them. All designations of part or parts mean part or parts by weight.

Example 1

Synthesis of an Isocyanate-containing Prepolymer

In a reaction tank equipped with a condenser, stirrer and nitrogen inlet tube, 724 parts of 2 moles ethylene oxide adduct of bisphenol A, 276 parts of isophthalic acid and 2 parts of dibutyltin oxide were charged. They were reacted at normal pressure and 230° C. for 8 hours, followed by reaction for further 5 hours while dehydrating under reduce pressure at 10 to 15 mHg. After cooling to 80° C., the residue was reacted with 188 parts of isophorone diisocyanate in ethyl acetate for 2 hours, whereby an isocyanate-containing prepolymer having a weight average molecular weight of 12000 was obtained.

Synthesis of Blocked Amine

In a reaction tank equipped with a stirring rod and thermometer, 30 parts of isophorone diamine and 70 parts of methyl ethyl ketone were charged, followed by reaction at 50° C. for 5 hours to yield the corresponding ketimine compound.

Synthesis of a Low-molecular-weight Polyester

In a similar manner to that described above, 724 parts of 2 moles ethylene oxide adduct of bisphenol A, 138 parts of terephthalic acid and 138 parts of isophthalic acid were polycondensed at 230° C. under normal pressure for 6 hours, followed by reaction for 5 hours while dehydrating under reduced pressure at 10 to 15 mmHg, whereby a low-molecular weight polyester (B-1) having a number average molecular weight of 1900 and a weight average molecular weight of 4000 was obtained.

Preparation of a Toner

In a beaker, 15.4 parts of the isocyanate-containing prepolymer and 64 parts of the component (B-2), each obtained above, and 78.6 parts of ethyl acetate were charged and they were stirred to dissolve the former in the latter. Then, 20 parts of pentaerythritol tetrabehenate and 4 parts of Cyanine blue KRO (product of Sanyo Color Works, Ltd.) were added to the resulting solution, followed by stirring at 60° C. and 12000 rpm in a TK homomixer for uniform dissolution and dispersion. In the end, 2.7 parts of the ketimine compound was added to the resulting solution to dissolve the former in the latter. The solution thus obtained was provided as a toner material solution.

In another beaker, 706 parts of deionized water, 294 parts of a 10% suspension of hydroxyapatite ("Supertite 10" produced by Nippon Chemical Industrial Co., Ltd.) and 0.2 part of sodium dodecylbenzenesulfonate were charged and dissolved uniformly. After heating to 60° C., the toner material solution was charged while stirring in a TK homomixer at 12000 rpm. Stirring was conducted for 10 minutes. Then, the resulting mixture was transferred to a flask equipped with a stirring rod and a thermometer and heated to 98° C. While effecting the urea-introducing reaction, the reaction mixture was subjected to solvent removal. After filtration, washing and drying, air classification was conducted, whereby toner particles having a particle size $d_{50}$ of 6 $\mu$m were obtained. Then, 100 parts of the resulting toner particles and 0.5 part of colloidal silica ("Aerosil R972", product of Nippon Aerosil Co., Ltd.) were mixed in a sample mill, whereby a toner (1) of the present invention was obtained. The toner particles were found to have a practical sphericity of 0.98.

It was also found that the toner binder component in the toner (1) had a Tg of 52° C., Tηof 123° C., TG' of 132° C. and peak molecular weights of 4500 and 70000; that the high-molecular-weight polyester (A-1) in the toner binder had a number average weight of 6000 and weight average molecular weight of 64000; and that MnA/MnB was 3.2, while the MwA/MwB was 16.

The difference (SPA-SPB) between the SP value (SPA) of the (A-1) and that (SPB) of the (B-1) in the toner binder was 0.31. The evaluation results are shown in Table 1.

Example 2

Synthesis of a Toner Binder

In a reaction tank equipped with a condenser, a stirrer and a nitrogen inlet tube, 343 parts of 2 moles ethylene oxide adduct of bisphenol A, 166 parts of isophthalic acid and 2 parts of dibutyltin oxide were charged and they were reacted at 230° C. Unwed normal pressure for 8 hours. After reaction for further 5 hours under a reduced pressure at 10 to 15 mmHg, the reaction mixture was cooled to 110 ° C. In toluene, 17 parts of isophorone diisocyanate were added to the reaction mixture. They were reacted at 110° C. for 5 hours, followed by solvent removal, whereby a high-molecular-weight urethane-containing polyester (A-2) having a number average molecular weight of 6500 and a weight average molecular weight of 72000 was obtained.

In a similar manner to that described above, 570 parts of 2 moles ethylene oxide adduct of bisphenol A and 217 parts of terephthalic acid were polycondensed at 230° C. Unwed normal pressure for 6 hours, whereby a low-molecular-weight polyester (B-2) having a number average molecular weight of 2000 and a weight average molecular weight of 4200 was obtained.

In 2000 parts of ethyl acetate, 200 parts of the (A-2) and 800 parts of the (B-2) were dissolved and mixed to yield an ethyl acetate solution of a toner binder (2).

A portion of the ethyl acetate solution was dried under reduced pressure to isolate the toner binder (2). It was found to have Tg of 55° C., Tη of 128° C., TG' of 140° C. and peak molecular weights of 5000 and 80000. The MnA/MnB was 3.3, while MwA/MwB was 17.

The difference (SPA-SPB) between the SP value (SPA) of the (A-2) and that (SPB) of the (B-2) in the toner binder was 0.27.

Preparation of a Toner

In a beaker, 240 parts of the ethyl acetate solution of the toner binder (2) obtained above, 20 parts of pentaerythritol tetrabehenate (melting point: 81° C., melt viscosity: 25 cps) and 4 parts of cyanine blue KRO (product of Sanyo Color Works, Ltd.) were charged, followed by stirring at 60° C. and 12000 rpm in a TK homomixer for uniform dissolution and dispersion.

In another beaker, 706 parts of deionized water, 294 parts of a 10% suspension of hydroxyapatite ("Supertite 10" produced by Nippon Chemical Industrial Co., Ltd.) and 0.2 part of sodium dodecylbenzenesulfonate were charged and dissolved uniformly. After heating to 60° C., the toner material solution was charged while stirring in a TK homomixer at 12000 rpm. Stirring was conducted for 10 minutes. Then, the resulting mixture was transferred to a flask equipped with a stirring rod and a thermometer and heated to 98° C. to remove the solvent. After filtration, washing and drying, air classification was conducted, whereby toner particles having a particle size $d_{50}$ of 6 $\mu$m were obtained. Then, 100 parts of the resulting toner particles and 0.5 part of colloidal silica ("Aerosil R972", product of Nippon Aerosil Co., Ltd.) were mixed in a sample mill, whereby a toner (2) of the present invention was obtained. The practical sphericity of the toner particles was found to be 0.96. The evaluation results are shown in Table 1.

Example 3

Synthesis of a Toner Binder

In a reaction tank equipped with a condenser, a stirrer and a nitrogen inlet tube, 330 parts of 2 moles ethylene oxide adduct of bisphenol A, 166 parts of isophthalic acid and 2 parts of dibutyltin oxide were charged. They were reacted at 230° C. Unwed normal pressure for 8 hours, followed by reaction for further 5 hours under a reduced pressure at 10 to 15 mmHg, whereby a high-molecular-weight polyester (A-3) having a number average molecular weight of 8000 and a weight average molecular weight of 35000 was obtained.

In 2000 parts of ethyl acetate, 200 parts of the (A-3) and 800 parts of the low-molecular-weight polyester (B-2) described in Example 2 were dissolved and mixed to yield an ethyl acetate solution of a toner binder (3).

A portion of the ethyl acetate solution was dried under reduced pressure to isolate the toner binder (3). It was found to have Tg of 53° C., Tη of 123° C., TG' of 136° C. and peak molecular weights of 5000 and 38000. The MnA/MnB was 4.0, while MwA/MwB was 8.3.

The difference (SPA-SPB) between the SP value (SPA) of the (A-3) and that (SPB) of the (B-3) in the toner binder was 0.36.

Preparation of a Toner

In a similar manner to Example 2 except for the use of the toner binder (3) instead, a toner (3) of the present invention was obtained. The toner particles were found to have a practical sphericity of 0.97. The evaluation results are shown in Table 1.

Example 4

Preparation of a Toner

In a beaker, 240 parts of the ethyl acetate solution of the toner binder (3) described in Example 3, 20 parts of pentaerythritol tetrabehenate (melting point: 81° C., melt viscosity: 25 cps) and 4 parts of Cyanine blue KRO (product of Sanyo Color Works, Ltd.) were charged, followed by stirring at 60° C. and 12000 rpm in a TK homomixer for uniform dissolution and dispersion.

In another beaker, 485 parts of deionized water and 75 parts of a polyacrylate salt type anionic aqueous solution of a water-soluble high-molecule (Carribon B, product of Sanyo Chemical Industries, Ltd.) were charged and dissolved uniformly. After heating to 60° C., the toner material solution was charged while stirring in a TK homomixer at 12000 rpm. Stirring was conducted for 10 minutes. Then, the resulting mixture was transferred to a flask equipped with a stirring rod and a thermometer and heated to 98° C. to remove the solvent. After filtration, washing and drying, air classification was conducted, whereby toner particles having a particle size $d_{50}$ of 6 $\mu$m were obtained. Then, 100 parts of the resulting toner particles and 0.5 part of colloidal silica ("Aerosil R972", product of Nippon Aerosil Co., Ltd.) were mixed in a sample mill, whereby a toner (4) of the present invention was obtained. The practical sphericity of the toner particles was found to be 0.97. The evaluation results are shown in Table 1.

Example 5

Preparation of a Toner

In a beaker, 240 parts of the ethyl acetate solution of the toner binder (3) described in Example 3, 20 parts of pentaerythritol tetrabehenate (melting point: 81° C., melt viscosity: 25 cps) and 4 parts of Cyanine blue KRO (product of Sanyo Color Works, Ltd.) were charged, followed by stirring at 60° C. and 12000 rpm in a TK homomixer for uniform dissolution and dispersion.

In another beaker, 532 parts of deionized water and 28 parts of a modified polyether type nonionic water-soluble high molecule (a compound obtained by adding a 25-moles ethylene oxide adduct of styrenated phenol to each end of polyethylene glycol (Mw: 6000) through tolylene diisocyanate) were charged and dissolved uniformly. After heating to 60° C., the toner material solution was charged while stirring at 12000 rpm in a TK homomixer. Stirring was conducted for 10 minutes. Then, the resulting mixture was transferred to a flask equipped with a stirring rod and a thermometer and heated to 98° C. to remove the solvent. After filtration, washing and drying, air classification was conducted, whereby toner particles having a particle size $d_{50}$ of 6 $\mu$m were obtained. Then, 100 parts of the resulting toner particles and 0.5 part of colloidal silica ("Aerosil R972", product of Nippon Aerosil Co., Ltd.) were mixed in a sample mill, whereby a toner (5) of the present invention was obtained. The practical sphericity of the toner particles was found to be 0.97. The evaluation results are shown in Table 1.

Comparative Example 1

Synthesis of a Toner Binder

With 2 parts of dibutyltin oxide as a catalyst, 354 parts of 2 moles ethylene oxide adduct of bisphenol A and 166. parts of isophthalic acid were polycondensed to yield a comparative toner binder (1) having a number average molecular weight of 3700 and a weight average molecular weight of 8000. The comparative toner binder (1) was found to have Tg of 57° C., Tη of 136° C., TG' of 133° C. and a peak molecular weight of 8900.

Preparation of a Toner

In a beaker were charged 100 parts of the comparative toner binder (1) obtained above, 200 parts of an ethyl acetate solution and 4 parts of Cyanine blue KRO (product of Sanyo Color Works, Ltd.), followed by stirring at 50° C. and 12000 rpm in a TK homomixer to dissolve and disperse them uniformly. In a similar manner to Example 1, a comparative toner (1) having a particle size $D_{50}$ of 6 $\mu$m was obtained. The resulting toner particles were found to have a practical sphericity of 0.98. The evaluation results are shown in Table 1.

TABLE 1

| Toner | Powder flowability | Heat storage stability | GLOSS | HOT | Charge quantity |
|---|---|---|---|---|---|
| Example 1 | 0.38 | 20% | 130° C. | 180° C. | −14.9 $\mu$C/g |
| Example 2 | 0.37 | 19% | 150° C. | 230° C. or greater | −15.1 $\mu$C/g |
| Example 3 | 0.37 | 20% | 130° C. | 180° C. | −15.5 $\mu$C/g |
| Example 4 | 0.39 | 20% | 130° C. | 180° C. | −17.3 $\mu$C/g |
| Example 5 | 0.39 | 20% | 130° C. | 180° C. | −17.1 $\mu$C/g |
| Comp. Ex. 1 | 0.35 | 21% | 150° C. | 160° C. | −15.3 $\mu$C/g |

Evaluation Method (1) Powder Flowability

Silent density was measured using a powder tester manufactured by Hosokawa Micron Inc. The toner having better flowability has greater silent density.

(2) Heat Storage Stability

After storing a toner at 50° C. for 8 hours, it was shifted through a 42-mesh sieve for 2 minutes. The remaining ratio on the metal mesh was designated as heat storage stability.

The remaining ratio is smaller as the toner has better heat storage stability.

(3) Gloss Exhibiting Temperature (GLOSS)

Fixation was evaluated using a remodeled machine obtained by removing, from the fixing apparatus of a commercially available copying machine (CLC-1, manufactured by Canon Inc.), the oil feeder and also removing the oil on the fixing roll. The fixing roll temperature at which the 60° gloss of the fixed image became at least 10% was designated as gloss exhibiting temperature.

(4) Hot offset occurring temperature (HOT)

Evaluation of fixing was conducted using the same machine with that used for evaluation of GLOSS and existence of hot offset to a fixed image was visually evaluated. The fixing roll temperature at which hot offset occurred was designated as a hot offset occurring temperature.

(5) Charge Quantity

For 30 minutes, 1 g of a toner and 24 g of an electrophotographic ferrite carrier ("FL 961-150", product of Powder Tech) were mixed for 30 minutes in a tumbler shaker mixer and charge quantity was measured by a blow-off charge quantity measuring apparatus (manufactured by Toshiba Chemical Corporation).

INDUSTRIAL APPLICABILITY

The dry toner according to the present invention exhibits the following advantages.

1. Excellent in powder flowability and therefore, excellent in developing performances and transferability.

2. Excellent in heat storage stability and at the same time, excellent in both of low-temperature fixing property and anti-hot offset property.

3. Owing to excellent gloss exhibition when used as a color toner and excellent anti-hot offset property, oil application to a fixing roll is not necessary.

4. Having high transparency and excellent color tone when used as a color toner.

What is claimed is:

1. A dry toner comprising a toner binder and a colorant, characterized in that:

said toner has a Wadell's practical sphericity ranging from 0.90 to 1.00;

said toner binder comprises a high-molecular weight polyester condensation resin (A) containing urea or urethane bonds and a low-molecular weight condensation resin (B);

a ratio (MnA/MnB) of the number average molecular weight (MnA) of said resin (A) to the number average molecular weight (MnB) of said resin (B) is at least 1.6; and a ratio (MwA/MwB) of the weight average molecular weight (MwA) of said resin (A) to the weight average molecular weight (MwB) of said resin (B) is at least 2.

2. A dry toner according to claim 1, wherein said toner binder has at least two peaks in the molecular weight distribution as measured by gel permeation chromatography (GPC).

3. A dry toner according to claim 1, wherein a difference (TG'−Tη) between a temperature (TG') at which the storage elastic modulus of said toner binder becomes 10000 dyne/$cm^2$ and a temperature (Tη) at which the viscosity of said toner binder becomes 1000 poises, each at a measuring frequency of 20 Hz is at least 0° C.

4. A dry toner according to claim 1, wherein said toner binder has a glass transition point (Tg) of 35 to 85° C.

5. A dry toner according to claim 1, wherein a difference (SPA-SPB) between the SP value (SPA) of said resin (A) and the SP value (SPB) of said resin (B) is at least 0.1.

6. A dry toner according to claim 1, wherein said resin (A) has a number average molecular weight (MnA) of 5000 or greater.

7. A dry toner according to claim 1, wherein a weight ratio of said resin (A) to said resin (B) ranges from 5/95 to 60/40.

8. A dry toner according to claim 1, wherein said resin (B) is at least one resin selected from the group consisting of polyester, polyamide, polyurethane, polyurea and epoxy resins.

9. A dry toner according to claim 1, wherein said resin (A) and said resin (B) are each a polyester resin comprising a polycondensate between a polyol and a polycarboxylic acid.

10. A dry toner according to claim 1, comprising toner particles formed from the dispersion of a toner material in an aqueous medium.

11. A dry toner according to claim 10, wherein said dispersion is obtained using an organic dispersing agent.

12. A dry toner according to claim 11, wherein said organic dispersing agent is at least one selected from the group consisting of water-soluble high molecules and surfactants.

13. A dry toner according to claim 1, wherein said colorant is selected from the group consisting of cyan, magenta, and yellow dyes.

14. A dry toner according to claim 1, wherein said colorant is selected from the group consisting of cyan, magenta, and yellow pigments.

* * * * *